United States Patent [19]

Douglass et al.

[11] 4,281,456

[45] Aug. 4, 1981

[54] RAZOR HANDLE WITH A PIVOTAL CONNECTION MEANS FOR AN ELEMENT OF A BLADE CARTRIDGE MOUNTED THEREON

[75] Inventors: Paul W. Douglass, Winchester; Robert A. Trotta, Winthrop, both of Mass.

[73] Assignee: The Gillette Company, Boston, Mass.

[21] Appl. No.: 93,847

[22] Filed: Nov. 13, 1979

[51] Int. Cl.[3] ..... B26B 21/06; B26B 21/22

[52] U.S. Cl. ..... 30/89

[58] Field of Search ..... 30/47, 50, 57, 87, 89

[56] References Cited

U.S. PATENT DOCUMENTS

| | | | |
|---|---|---|---|
| 2,311,913 | 2/1943 | Testi | 30/62 |
| 2,654,148 | 10/1953 | Robinson | 30/32 |
| 2,748,470 | 6/1956 | Borden | 30/89 |
| 3,396,464 | 8/1968 | Treiss | 30/87 X |
| 3,740,841 | 6/1973 | Risher | 30/89 |
| 3,768,162 | 10/1973 | Perry | 30/47 |
| 3,816,912 | 6/1974 | Glaberson | 30/47 |
| 3,816,916 | 6/1974 | Kuhnl | 30/47 |
| 3,871,077 | 3/1975 | Nissen | 30/63 |
| 3,935,639 | 2/1976 | Terry | 30/47 |
| 3,950,849 | 4/1976 | Perry | 30/47 |
| 4,026,016 | 5/1977 | Nissen | 30/50 X |
| 4,083,104 | 4/1978 | Nissen | 30/47 |

*Primary Examiner*—Gary L. Smith
*Attorney, Agent, or Firm*—Scott R. Foster

[57] ABSTRACT

A razor handle for use in conjunction with a replaceable blade assembly, the handle including a grip portion, a neck portion extending from the grip portion, a first connector extending from a free end of the neck portion and adapted to engage a blade assembly to form a pivotal connection therebetween, and a second connector extending from the free end of the neck portion and adapted to fixedly interconnect with the blade assembly.

7 Claims, 11 Drawing Figures

RAZOR HANDLE WITH A PIVOTAL CONNECTION MEANS FOR AN ELEMENT OF A BLADE CARTRIDGE MOUNTED THEREON

BACKGROUND OF THE INVENTION

1. Field of the Invention

This invention relates to wet shaving devices, and is directed more particularly to a razor handle adapted for use with replaceable blade assemblies.

2. Description of the Prior Art

Safety razors conventionally comprise a guard member and a cap member between which, in use, a disposable razor blade is sandwiched, and a handle, the guard member, the cap member, and the handle being fixed relative to one another. The latter feature is present in the conventional one-piece and "three-piece" razors designed to take disposable double-edged blades. Safety razors have recently appeared on the market which comprise, instead of disposable razor blades, a disposable razor blade assembly, or head, having a guard member, one or more blades, and a cap member held rigidly together. The disposable razor blade assembly is rigidly attached to a handle so that the razor edges are at a fixed angular attitude relative to the handle. The blade assembly is replaced as a whole when the razor cutting edge (or edges) becomes dull.

Continuing efforts are being made to improve the shaving characteristics of such implements and/or to accommodate individual preferences. A factor in shaving efficiency and effectiveness is the orientation of the active components of the shaving system relative to the skin surface being shaved. The surface frequently has undulations or is in a relatively inaccessible or awkward area to reach and the shaving action is reduced in efficiency because the relationship of the active element to the skin surface being shaved significantly departs from the optimum valve. Razors in which there is a fixed relationship between the shaving unit and the handle call for considerable dexterity on the part of the user and substantial changes in the disposition of the handle in order to maintain the shaving unit at its optimum attitude on the shaver's face, particularly when negotiating areas, such as the jaw line, where there are gross changes in facial contours.

Recent improvements have resulted in a shaving system as described in U.S. Pat. No. 4,020,016 in which a blade assembly is pivotally mounted on a handle such that the blade assembly is movable relative to the grip portion of the handle in a manner conformable or responsive to the surface of the skin being shaved. While such shaving system has been imminently successful from a commercial standpoint, there are shavers who prefer the stability of a blade assembly fixed to a handle, as opposed to a freely pivotable blade assembly.

SUMMARY OF THE INVENTION

An object of the present invention is to provide a razor handle adapted for use with a replaceable blade assembly, the handle having facility for maintaining the blade assembly in a fixed position until a particular force is applied against the blade assembly, the razor handle being adapted, upon application of such force, to facilitate movement of the blade assembly during the shaving operation, to a safer attitude.

With the above and other objects in view, as will hereinafter appear, a feature of the present invention is the provision or a razor handle for use in conjunction with a replaceable blade assembly, the handle having a grip portion, a neck portion extending from the grip portion, a first connecting means extending from a free end of the neck portion and adapted to engage a blade assembly to form a pivotal connection therebetween, and a second connecting means extending from the free end of the neck portion and adapted to fixedly interconnect with the blade assembly.

In accordance with a further feature of the invention, the first connecting means is pivotally mounted on the neck portion of the razor and the second connecting means is movably disposed on the razor.

In accordance with a still further feature of the invention, the second connecting means is spring biased to maintain the blade assembly in a rigid position until force applied to the blade assembly overcomes the maintaining force of the spring.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
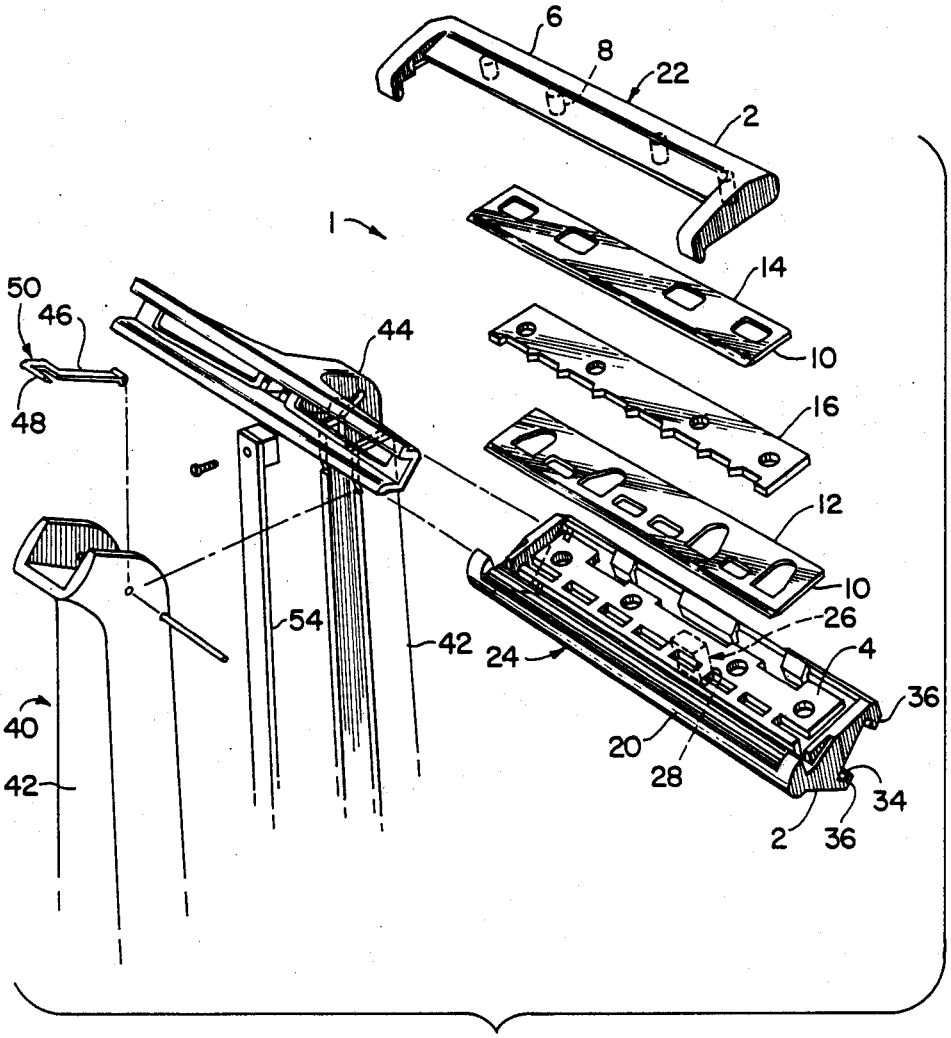
FIG. 1 is an exploded perspective view of a head portion of a razor handle illustrative of the invention, along with a replaceable blade assembly suitable for use with the razor handle.
Figure 2:
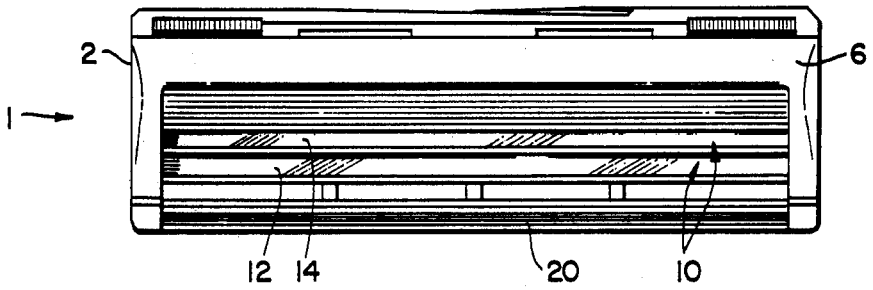
FIG. 2 is a top plan view of the blade assembly.
Figure 3:
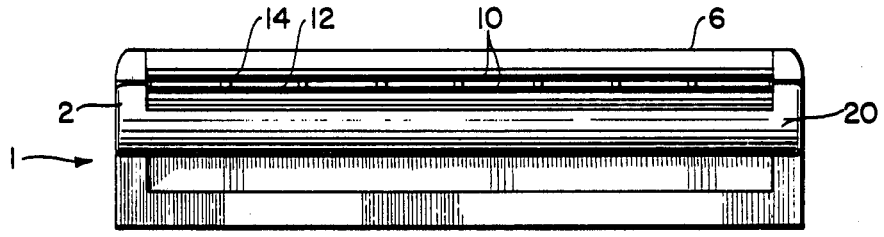
FIG. 3 is a front elevational view of the blade assembly.
Figure 4:
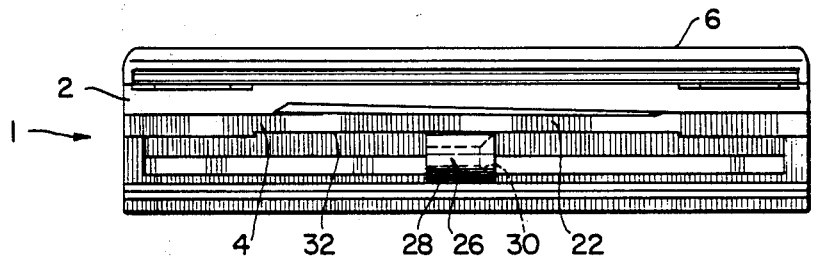
FIG. 4 is a back elevational view of the blade assembly.
Figure 5:
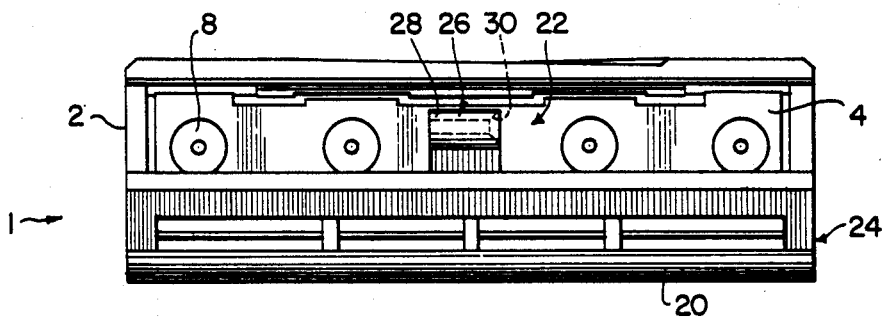
FIG. 5 is a bottom view of the blade assembly.

Referring to the drawings, it will be seen that an illustrative razor blade assembly 1 comprises a body 2, which may be of molded plastic. The body 2 may comprise a platform portion 4 to which is fixed a cap portion 6, as by rivet means 8. Permanently fixed between the platform and cap portions 4, 6 are blade means 10 which may, as illustrated, include first and second blades 12, 14 separated by a spacer means 16. Preferably, the rivet means 8 extend through the blades 12, 14 and spacer 16 to securely join the blade assembly components.

Connected to the platform portion 4 by means of a relatively thin molded web 18 is a guard portion 20. The web 18 is an integrally molded portion of the body portion which hingedly interconnects the platform portion 4 and the guard portion 20. Thus, a first portion 22 of the body 2 is pivotally joined, by way of the web 18, to a second portion 24 of the body.

Disposed on the first portion 22 of the body 2 is a first connecting means 26 by which the blade assembly may be pivotally connected to a razor handle, as will be further described hereinbelow. The first connecting means, as illustrated, comprises a projection 28 extending downwardly, as viewed in the drawings, and having therein an opening 30 for pivotally receiving a handle connecting means. The projection 28 is disposed centrally of the blade assembly, extending from an undersurface 32 of the platform portion 4.

Disposed on the second portion 24 of the body 2 is a second connecting means 34 by which the blade assembly may be fixedly connected to the razor handle, as will be further described hereinbelow. The second connecting means, as illustrated, comprise a pair of parallel elongated rails 36 extending lengthwise of the blade assembly, in known fashion. The rails 36 define opposed grooves 38 which comprise a blade assembly slide means and are adapted to slidingly receive a razor handle slide means.

Accordingly, the first portion 22 of the body 2 is adapted to be pivotally connected to the razor handle, while the second portion 24 is adapted to be fixedly connected to the razor handle, the first and second portions 22, 24 being pivotally joined to each other.

A razor handle 40 suitable for use with the illustrative blade assembly includes a grip portion 42 and a neck portion 44. Pivotally connected to the grip portion 42 is a lever 46 having at its upper end a dowel portion 48 adapted to engage the opening 30 of the blade assembly projection 28. Thus, the lever 46 comprises a handle first connecting means 50 adapted to engage the blade assembly first connecting means 26 to form a pivotal connection.

The razor handle neck portion 44 is provided with a pair of parallel elongated rails 52 adapted to slidingly engage the grooves 38 to fixedly interconnect the handle and the blade assembly. The rails 52 accordingly constitute a razor handle second connecting means 54 adapted to be fixedly connected to the blade assembly second connecting means 34.

The grip portion 42 of the handle 40 has anchored therein a leaf spring 54 which extends into, and is attached to, the neck portion 44. The neck portion 44 is connected to the grip portion 42 by the spring 54 and, upon flexing of the spring 54, is moveable relative to the grip portion.

The razor handle 40 may be connected to the blade assembly 1 by engaging the rails 52 with the grooves 38 and the dowel portion 48 with the projection 28, thereby effecting a first pivotal connection between the handle and the blade assembly body first portion 22, and effecting a second fixed connection between the handle and the blade assembly body second portion 24.

Figure 6:
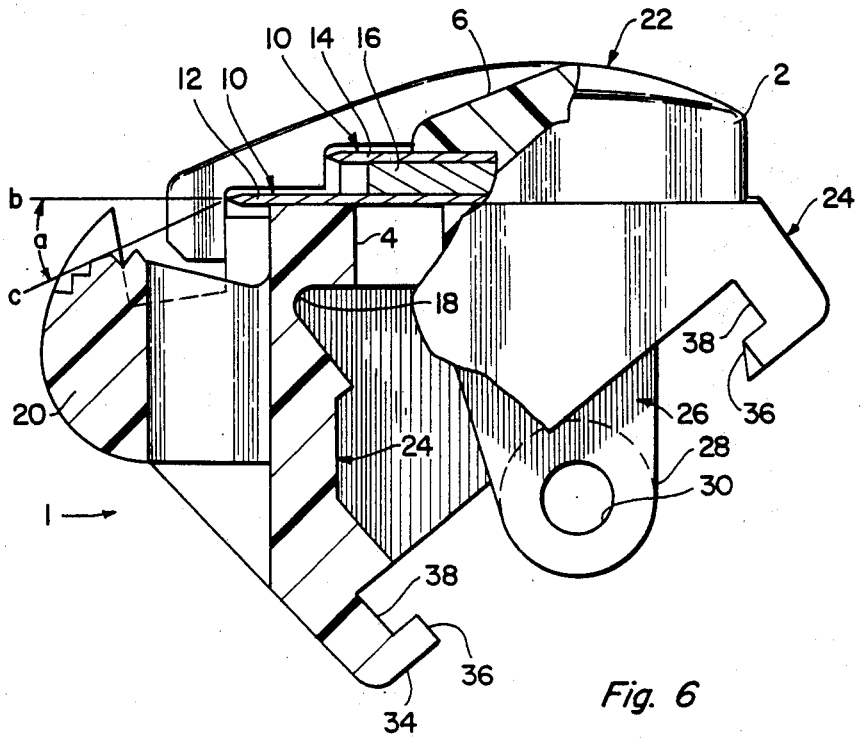
FIG. 6 is a side elevational view, in part cut away, of the blade assembly.
Figure 7:
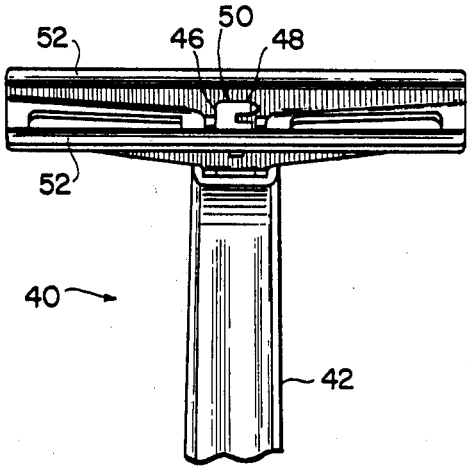
FIG. 7 is a front elevational view of the head portion of the razor handle.
Figure 8:
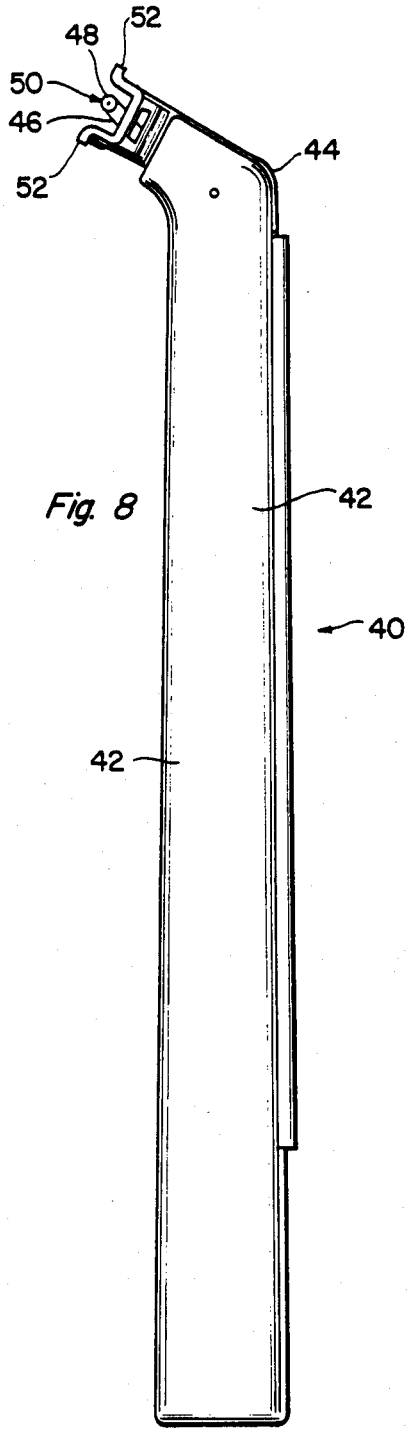
FIG. 8 is a side elevational view of the handle.
Figure 9:
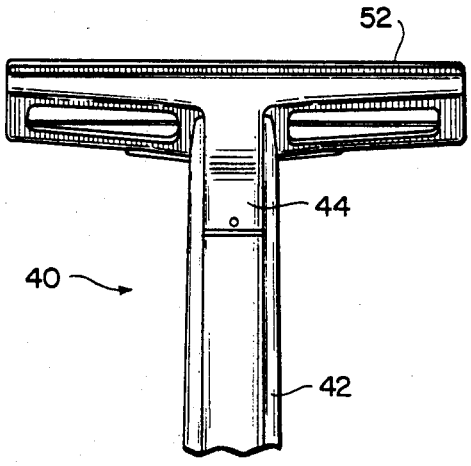
FIG. 9 is a back elevational view of the handle head portion.
Figure 10:
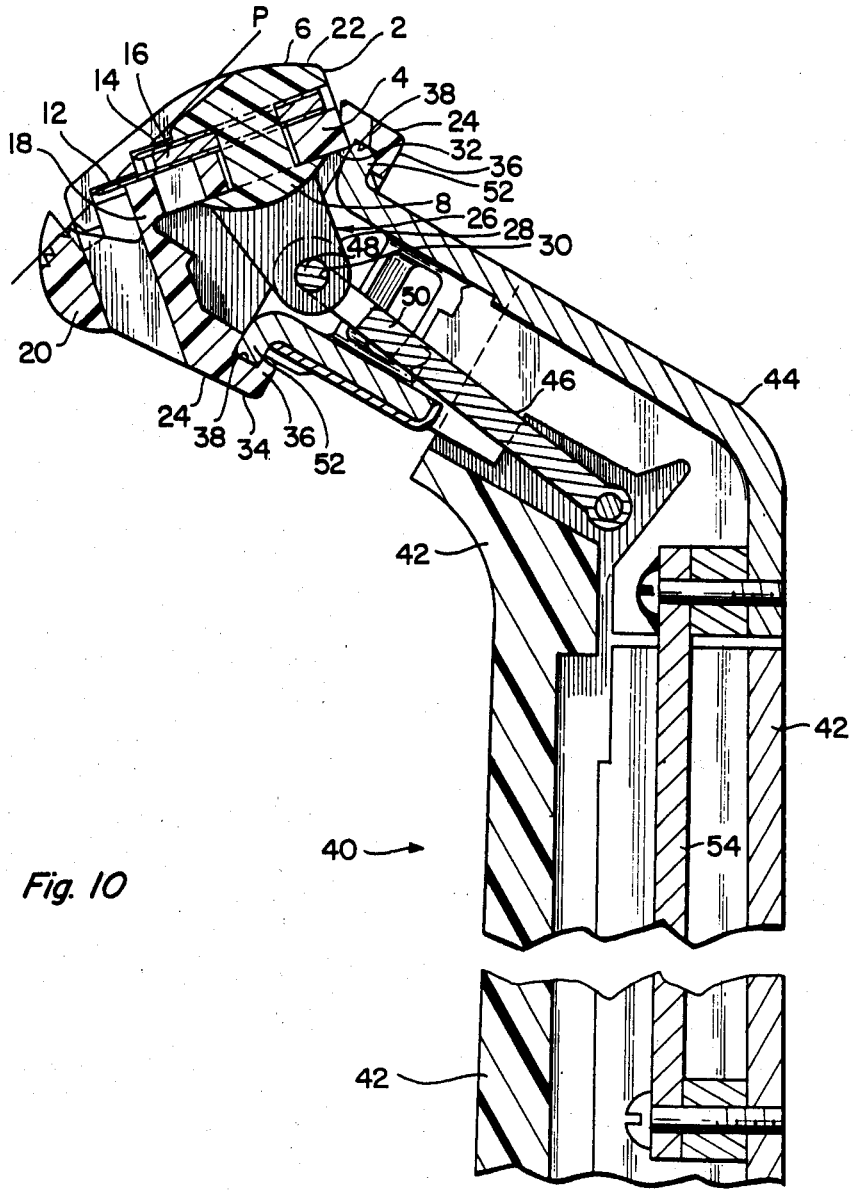
FIG. 10 is a side sectional view of the razor handle and blade assembly interconnected for a shaving operation, and shown in a first position.
Figure 11:
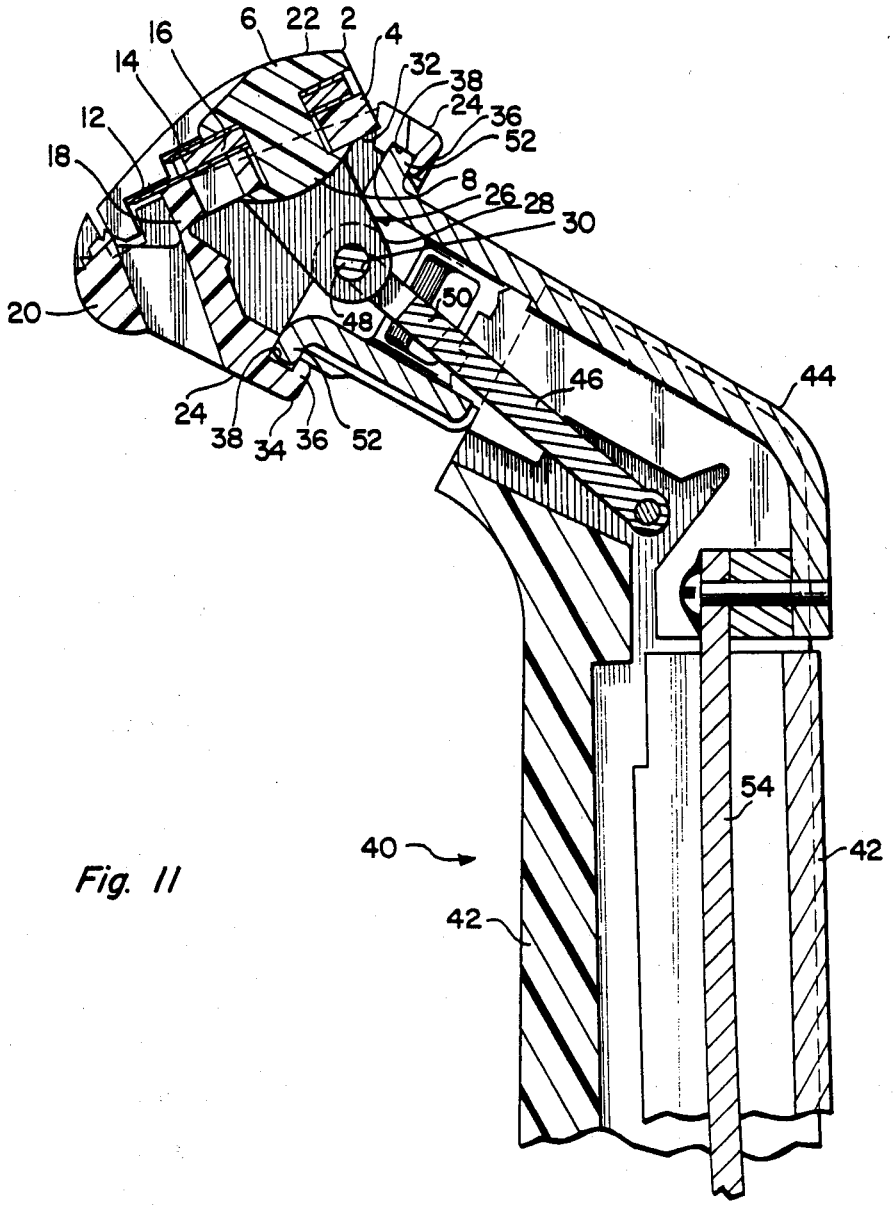
FIG. 11 is similar to FIG. 10, but showing the handle and blade assembly in a second position.

In use, the blade assembly behaves in much the same manner as blade assemblies of the type fixedly and immovably connected to their handles, until a particular force level is exerted on the razor. When the blade assembly is urged by the operator against the surface being shaved with sufficient force to overcome the bias of the spring 54, the neck portion 44 moves to the right, as viewed in FIGS. 10 and 11, as, for example, from a first position as shown in FIG. 10 to a second position as shown in FIG. 11, permitting the blade assembly first portion 22 to pivot about the lever 46, which is pivotally anchored to the grip portion 42 of the handle. The blade assembly second portion 24 is fixedly connected to the rails 52 and therefore moves with the neck portion 44, causing pivotal movement between the first and second portions of the blade assembly. Such movement between the first and second portions of the blade assembly has the effect of relatively withdrawing the first blade rearwardly behind a plane P (FIG. 10) extending from the cutting edge of the second blade to a guard portion tangent point, and further, of decreasing the angle a (FIG. 6) formed by a first line b extending through the plane of the first blade 12 and a second line c extending from the cutting edge of the first blade to a tangent point on the guard portion. Thus, as excess pressure is applied by the operator, the "exposure" of the blades is decreased and the "blade tangent angle" is decreased.

"Exposure" and "blade tangent angle" are defined and discussed in U.S. Pat. No. 3,786,563, issued Jan. 22, 1974 in the names of Francis W. Dorion, Jr., et al. "Blade tangent angle" is defined as the angle between the bisector of the included angle of the cutting edge (the plane of the blade if the cutting edge is symmetrical) and a line from the cutting edge tangent to the skin engaging surface immediately forward of that cutting edge (in this instance, the guard portion). "Exposure" is defined as the distance, measured perpendicularly to a reference plane defined by skin engaging surfaces immediately in front of and behind the cutting edge (the plane P), from the cutting edge to that plane, the exposure being considered positive when the cutting edge is located on the outer (skin) side of that plane and being considered negative when the cutting edge is further from the skin than that plane.

Thus, excessive pressure, which normally might endanger the operator, causes a marked decrease in the exposure of the first cutting edge and a marked decrease in the blade tangent angle, thereby rendering the system safer and much less likely to inflict harm on the operator. The more forceful the operator becomes, the safer the system becomes. The shaving geometry is varied inversely with the force of the blade assembly on the surface being shaved. The system, however, becomes force sensitive only after a specific force, or load level, is reached. Before such force level is reached, the shaving geometry of the cartridge is static and similar to the geometry of systems now in public use.

In a preferred embodiment, after the force level is reached, the blade assembly starts to automatically adjust the blade tangent angle of the first blade from approximately 26° to approximately 15°, and the exposure of the first blade from 0.0015 inch to 0.004 inch. When the razor is lifted from the surface being shaved, a force load is no longer exerted on the blade assembly and the shaving geometry reverts to its normal static geometry.

It is preferred that the threshold sensing force be about 50 grams. Thus, with forces up to 50 grams, the blade assembly geometry remains in its static condition, with forces exceeding 50 grams, the razor starts decreasing the blade assembly geometry (blade tangent angle and exposure).

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A razor handle for use in conjunction with a replaceable blade assembly, the handle comprising a grip portion, a neck portion attached to said grip portion, a first connecting means extending from said grip portion and adapted to engage said blade assembly to form a pivotal connection therebetween, and a second connecting means extending from said neck portion and adapted to fixedly interconnect with mounting means on said blade assembly, said first connecting means being rigid and being pivotally anchored in said grip portion and said neck portion being moveably attached to said grip portion.

2. The invention in accordance with claim 1 in which said first connecting means comprises a lever member having means at its free end adapted to engage a projection extending from said blade assembly, said lever member forming said pivotal connection with said projection.

3. The invention in accordance with claim 2 in which said second connecting means comprises a first slide means and said blade assembly mounting means comprises second slide means, said first slide means being adapted to be received by said second slide means.

4. The invention in accordance with claim 3 in which said first slide means comprises rails extending from said neck portion, said neck portion being moveable in directions transverse to an axis of said grip portion.

5. The invention in accordance with claim 4 including spring means for biasing said neck portion toward a first position but yieldable to permit movement of said neck portion towards a second position.

6. A razor handle for use in conjunction with a replaceable blade assembly, the handle comprising a grip portion, a rigid lever pivotally connected to said grip portion, said lever having means at its free end for pivotal attachment to a blade assembly, said handle further comprising a neck portion, connecting means extending from said neck portion and adapted to fixedly interconnect with mounting means on said blade assembly, said neck portion being moveably attached to said grip portion and being moveable in directions transverse to a lengthwise axis of said grip portion.

7. The invention in accordance with claim 6 including a leaf spring anchored in said grip portion and attached at one end thereof to said neck portion whereby to interconnect said grip portion and said neck portion.

* * * * *